US009657700B2

(12) United States Patent
Schanz et al.

(10) Patent No.: US 9,657,700 B2
(45) Date of Patent: May 23, 2017

(54) INLET VALVE ARRANGEMENT FOR A FUEL PUMP

(75) Inventors: Robert Schanz, Klipphausen (DE); Paul Buckley, Rainham (GB); Rainer Jorach, Remseck (DE)

(73) Assignee: Delphi International Operations Luxembourg SARL, Luxembourg (LU)

( * ) Notice: Subject to any disclaimer, the term of this patent is extended or adjusted under 35 U.S.C. 154(b) by 382 days.

(21) Appl. No.: 14/125,097

(22) PCT Filed: Jun. 13, 2012

(86) PCT No.: PCT/EP2012/061229

§ 371 (c)(1),
(2), (4) Date: Dec. 10, 2013

(87) PCT Pub. No.: WO2012/171970

PCT Pub. Date: Dec. 20, 2012

(65) Prior Publication Data

US 2014/0134027 A1 May 15, 2014

(30) Foreign Application Priority Data

Jun. 15, 2011 (EP) ..... 11169958

(51) Int. Cl.
*F02M 59/46* (2006.01)
*F02D 41/38* (2006.01)
(Continued)

(52) U.S. Cl.
CPC ..... *F02M 59/464* (2013.01); *F02D 41/3836* (2013.01); *F02D 41/3845* (2013.01);
(Continued)

(58) Field of Classification Search
CPC ..... F02M 59/368; F02M 59/464; F02M 63/0225; F02M 55/025; F02M 59/06;
(Continued)

(56) References Cited

U.S. PATENT DOCUMENTS 5,109,822 A 5/1992 Martin
6,016,790 A * 1/2000 Makino ..... F02M 59/06 123/458
(Continued)

FOREIGN PATENT DOCUMENTS

DE 100 38 083 A1 3/2001
DE 102 47 436 A1 5/2003
(Continued)

OTHER PUBLICATIONS

International Search Report dated Aug. 10, 2012.

*Primary Examiner* — Dominick L Plakkoottam
(74) *Attorney, Agent, or Firm* — Joshua M. Haines

(57) ABSTRACT

An inlet valve arrangement for a pump head of a fuel pump for use in a common rail fuel injection system comprises an inlet valve member moveable between open and closed positions to control the flow from a source of low-pressure fuel to a pumping chamber of the fuel pump. The inlet valve member is arranged to open in response to the pressure difference between the fluid pressure of fuel on an inlet side of the inlet valve member and the fluid pressure in the pumping chamber exceeding a threshold value. The inlet valve arrangement comprises means for selectively applying a closing force on the inlet valve member to bias it toward the closed position, such that, in use, the application of the closing force by said means acts to increase the threshold value of the pressure difference at which the inlet valve member opens.

15 Claims, 1 Drawing Sheet

(51) Int. Cl.

| | |
|---|---|
| ***F02M 63/02*** | (2006.01) |
| ***F04B 49/22*** | (2006.01) |
| ***F04B 1/04*** | (2006.01) |
| ***F04B 7/00*** | (2006.01) |
| *F02M 59/36* | (2006.01) |

(52) U.S. Cl.
CPC ..... *F02M 59/366* (2013.01); *F02M 59/368* (2013.01); *F02M 59/46* (2013.01); *F02M 63/0225* (2013.01); *F04B 1/0452* (2013.01); *F04B 7/0076* (2013.01); *F04B 49/225* (2013.01); *F02D 2250/31* (2013.01); *F02M 59/367* (2013.01); *Y10T 137/85978* (2015.04)

(58) Field of Classification Search
CPC .... F02M 59/366; F02M 59/367; F02M 59/46; F02M 59/466; F02M 2200/04; F02M 2200/31; F02M 39/00; F02M 47/027; F02M 59/36; F02M 63/0017; F04B 1/0452; F04B 7/0076; F04B 49/225; F04B 49/243; Y10T 137/85978; F02D 2200/0602; F02D 2250/31; F02D 2041/3881; F02D 2041/389; F02D 41/3809; F02D 41/3836; F02D 41/3845; F02D 41/3872
See application file for complete search history.

(56) References Cited

U.S. PATENT DOCUMENTS

| | | | | |
|---|---|---|---|---|
| 6,332,454 | B1 | 12/2001 | Itabashi et al. | |
| 6,530,363 | B1 * | 3/2003 | Blass | F02M 39/00 123/446 |
| 7,451,741 | B1 | 11/2008 | Bartley et al. | |
| 2002/0033167 | A1 * | 3/2002 | Hiraku | F02D 41/3845 123/456 |
| 2007/0101972 | A1 * | 5/2007 | Majima | F02D 41/3836 123/458 |
| 2008/0216797 | A1 | 9/2008 | Oono | |
| 2011/0120418 | A1 | 5/2011 | Cheron et al. | |

FOREIGN PATENT DOCUMENTS

| | | | | |
|---|---|---|---|---|
| DE | 10 2004 016 554 | A1 | 10/2005 | |
| DE | 10 2008 018 018 | A1 | 10/2009 | |
| DE | 102008018018 | A1 * | 10/2009 | F02M 59/06 |
| EP | 1 887 206 | A1 | 2/2008 | |
| WO | 2010/007409 | A1 | 1/2010 | |

* cited by examiner

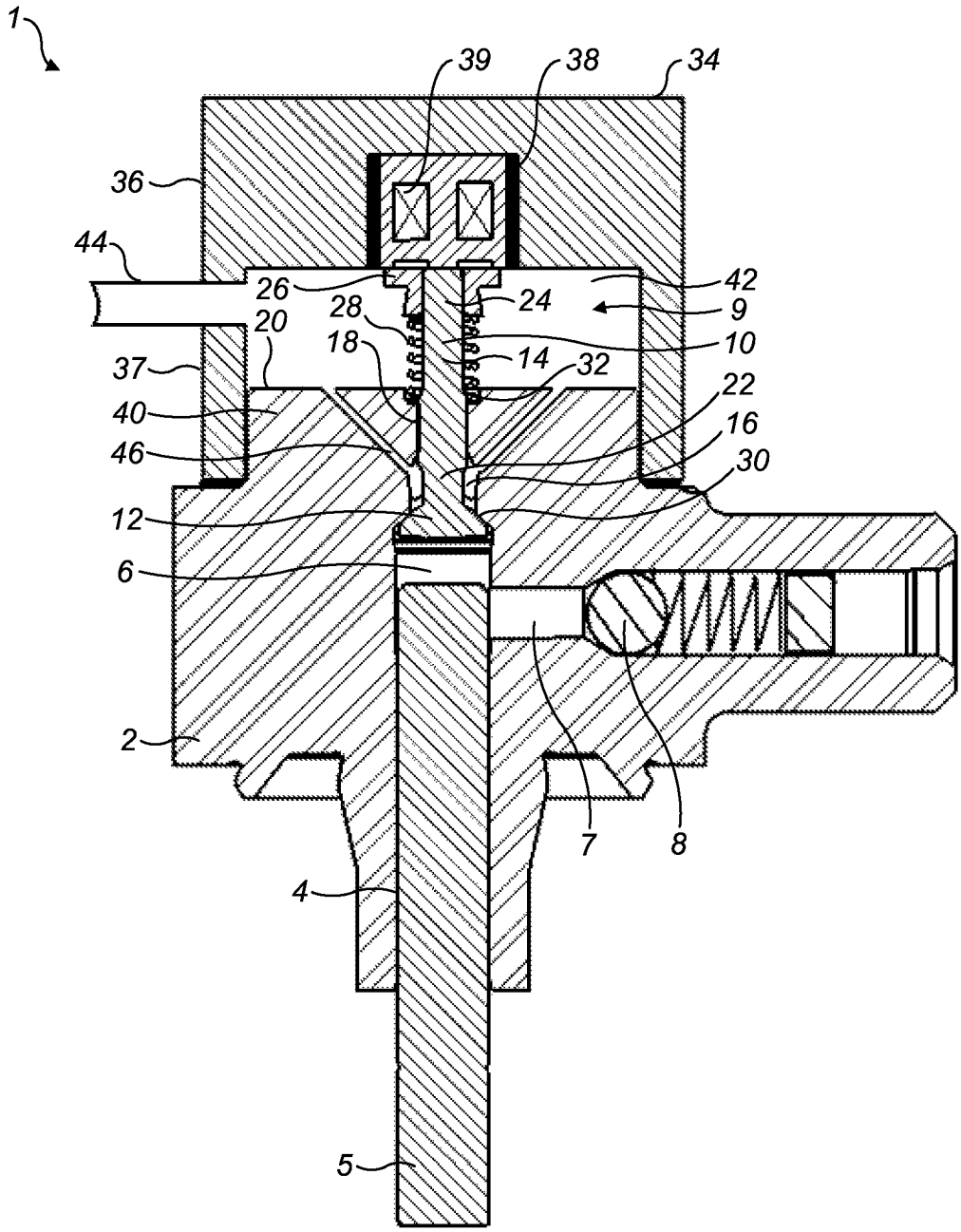
1
39
38
34
36
44
26
28
24
42
9
20
18
10
14
32
37
22
40
16
46
30
12
6
2
7
8
4
5

INLET VALVE ARRANGEMENT FOR A FUEL PUMP

CROSS REFERENCE TO RELATED APPLICATIONS

This application is a national stage application under 35 U.S.C. 371 of PCT Application No. PCT/EP2012/061229 having an international filing date of 13 Jun. 2012, which designated the United States, which PCT application claimed the benefit of European Patent Application No. 11169958.3 filed 15 Jun. 2011, the entire disclosure of each of which are hereby incorporated herein by reference.

FIELD OF THE INVENTION

The present invention relates to an inlet valve arrangement and, in particular, an inlet valve arrangement for a pump head of a fuel pump for use in a common rail fuel injection system.

BACKGROUND ART

High-pressure fuel pumps for common rail fuel injection systems typically comprise one or more hydraulic pump heads where fuel is pressurised in a pumping chamber of the pump head by the reciprocating movement of a plunger. Typically, low-pressure fuel is fed to the pump heads by a low-pressure lift pump in the fuel tank, or alternatively by a transfer pump built into the high-pressure fuel pump. Once pressurised, the high-pressure fuel is fed from the pumping chamber to the common rail.

An inlet metering valve is used to limit the fuel that is fed to the high-pressure pump to be compressed and delivered to the common rail. A conventional inlet metering valve is effectively a controllable orifice, which acts to throttle the flow of fuel to the inlet valve of the high-pressure pump in order to control the pressure on the inlet side of the valve, which is typically spring-biased into a closed position. Accordingly, the pressure at the inlet side of the valve determines when the valve opens and the quantity of fuel delivered to the pumping chamber. In this way, only the amount of fuel required by the engine is delivered to the rail, thereby saving both fuel and energy compared to the situation where fuel is fed by the lift or transfer pump at constant full delivery.

However, there are a number of disadvantages to conventional inlet metering valves. In particular, such valves are expensive and add to the overall cost of the common rail injection system, which is undesirable. Secondly, inlet metering valves are relatively large and space consuming components. Thirdly, such valves are vulnerable to wear and to bad fuels, which has a detrimental effect upon the common rail injection system in which they are installed. Furthermore, the use of a conventional inlet metering valve means that the metering/rail pressure control mechanism is relatively far from the pumping chamber of the high-pressure fuel pump, which leads to undesirable delays in rail pressure control.

It is an object of the present invention to provide an inlet valve arrangement for the pump head of a high-pressure fuel pump which substantially overcomes or mitigates at least some of the above-mentioned problems.

For more information relating to an inlet valve arrangement for a high pressure fluid pump, the reader is directed to German patent application number 10-2008-018018 in the name of Continental Automotive GmbH.

SUMMARY OF THE INVENTION

According to a first aspect of the present invention, there is provided an inlet valve arrangement for use in a common rail fuel injection system, the inlet valve arrangement comprising;

an inlet valve member moveable between open and closed positions to control the flow from a source of fuel at a first pressure on an inlet side of the inlet valve member to a chamber on an outlet side of the inlet valve member, wherein the inlet valve member is arranged to open in response to the pressure difference between the fluid pressure of fuel on the inlet side and the fluid pressure in the chamber exceeding a threshold value;

the inlet valve arrangement comprising means for selectively applying a closing force on the inlet valve member to bias it toward the closed position, such that, in use, the application of the closing force by said means acts to increase the threshold value of the pressure difference at which the inlet valve member opens.

The inlet valve arrangement according to the first aspect of the present invention has a particular application in the pump head of a fuel pump for use in a common rail fuel injection system, wherein the inlet valve member is moveable between open and closed positions to control the flow from a source of low-pressure fuel to a pumping chamber of the fuel pump, and the inlet valve member is arranged to open in response to the pressure difference between the fluid pressure of fuel on an inlet side of the inlet valve member and the fluid pressure in the pumping chamber exceeding a threshold value.

Thus, by selectively applying a closing force on the inlet valve member, it is possible to vary the threshold value of the pressure difference across the inlet valve member which is required to open the valve. This, in turn, varies the time at which the inlet valve member opens and closes during operation of a fuel pump to which the inlet valve arrangement is installed and, moreover, varies the amount of fuel delivered to pumping chamber of the fuel pump. Accordingly, the requirement for a conventional inlet metering valve is obviated. Preferably, the means for selectively applying the closing force is operable to apply a force which varies proportionally with a control signal, which may be a control current.

Preferably, said means comprises an electrical component in the form of a solenoid coil operable to exert a closing force on the inlet valve member which is proportional to an electric current flowing therein.

More preferably, the inlet valve arrangement comprises an armature of ferromagnetic material coupled to the inlet valve member, such that the solenoid coil exerts an electromagnetic force on the armature when an electric current flows within the solenoid coil.

Conveniently, the inlet valve arrangement comprises a spring arranged to bias the inlet valve member toward the closed position, wherein the threshold value of the pressure difference corresponds to an opening force on the inlet valve member which is greater than the closing force exerted by the spring.

According to a second aspect of the present invention, there is provided a pump head for a fuel pump for use in a common rail fuel injection system, the pump head comprising a pump head housing and an inlet valve arrangement according to the first aspect.

Preferably, the fluid pressure of fuel on the inlet side of the inlet valve member is defined by the fluid pressure within a gallery, wherein the gallery communicates with an external chamber defined in part by a closure member mounted externally to the pump head housing, such that, in use, the gallery communicates with the source of low-pressure fuel via the external chamber.

More preferably, the external chamber comprises an entry port, the entry port being adapted so as to restrict the flow from the source of low-pressure fuel into the external chamber such that, in use, the maximum fluid pressure in the external chamber is limited to a pressure which is less than the output pressure of the source of low-pressure fuel. Even more preferably, the entry port is provided in the closure member.

Preferably, the inlet valve member comprises an elongate neck which is guided within a valve bore in the pump head housing, the valve bore extending between an upper surface of the pump head housing and a valve seat.

More preferably, the external chamber is defined between the closure member and the upper surface of the pump head housing; and a distal end of the neck, disposed away from the valve seat, projects above the upper surface of the pump head housing into the external chamber.

Even more preferably, said means comprises a solenoid coil operable to exert a closing force on the inlet valve member which is proportional to an electric current flowing therein;

the inlet valve arrangement comprises an armature of ferromagnetic material coupled to the inlet valve member, such that the solenoid coil exerts an electromagnetic force on the armature when an electric current flows within the solenoid coil, and a spring arranged to bias the inlet valve member toward the closed position, wherein the threshold value of the pressure difference corresponds to an opening force on the inlet valve member which is greater than the closing force exerted by the spring;

and the armature projects radially outwards from the distal end of the neck and acts as a spring seat, the spring being disposed between the armature and the upper surface of the pump head housing.

Still more preferably, the solenoid coil is mounted in or on the closure member such that, when closure member is mounted on the pump head housing, the solenoid coil is disposed adjacent to, and coaxial with, the inlet valve member and, conveniently, the distal end of the neck of the inlet valve member.

According to a third aspect of the present invention, there is provided a fuel pump for use in a common rail fuel injection system, comprising at least one pump head according to the second aspect.

It will be appreciated that preferred and/or optional features of the first aspect of the invention may be incorporated alone or in appropriate combination in the pump head of the second aspect and/or the fuel pump of the third aspect.

BRIEF DESCRIPTION OF THE DRAWINGS

An embodiment of the present invention will now be described, by way of example only, with reference to the accompanying drawings, in which;

FIG. 1 is a schematic view of a fuel pump head having an embodiment of an inlet valve arrangement according to the present invention.

DETAILED DESCRIPTION OF THE PREFERRED EMBODIMENTS

Referring to FIG. 1, the pump head 1 comprises a pump head housing 2. The pump head housing 2 has a plunger bore 4 in which a pumping plunger 5 is disposed for reciprocating movement therein. As described in, for example, International Patent Application WO-A1-2010-007409 (published as U.S. Patent Application Publication 2011/0120418A1) in the name of the Applicant, a lower end of the pumping plunger 5 includes a foot which is driven by a cam mounted on a drive shaft (not shown in FIG. 1). As the drive shaft rotates, the cam imparts an axial force on the plunger foot, causing the pumping plunger 5 to reciprocate within the plunger bore 4. The pump head housing 2 defines a pumping chamber 6 at an upper end of the plunger bore 4, such that fuel is pressurised within the pumping chamber 6 by the reciprocal motion of the pumping plunger 5 within the plunger bore 4.

Low-pressure fuel is fed to the pumping chamber 6 by a low-pressure lift pump in a fuel tank (not shown in FIG. 1), or alternatively by a transfer pump built into the high-pressure fuel pump. The pump head housing 2 includes an exit drilling 7 in fluid communication with the pumping chamber 6. In use, pressurised fuel is fed from the pumping chamber 6, along the exit drilling 7, and through an outlet valve 8 to downstream components of a fuel injection system, such as a common rail.

The fuel pump head 1 includes an inlet valve arrangement 9 which comprises a moveable inlet valve member 10 for controlling fuel flow into the pumping chamber 6. The inlet valve member 10 has a conical body 12 and an elongate neck 14 and is moveable between open and closed positions in response to the fuel pressure in a gallery 16, which is machined in the pump head housing 2 above the pumping chamber 6, so as to surround a frustoconical lower end surface of the inlet valve member 10.

The conical body 12 is housed within the pump head housing 2, adjacent to the pumping chamber 6, whilst the neck 14 extends from the conical body 12, coaxially with the plunger bore 4, away from the pumping chamber 6. The neck 14 is slidable within a valve bore 18 defined by the pump head housing 2. Consequently, the inlet valve member 10 is guided by the pump head housing 2 at the lower end of the neck 14.

The neck 14 of the inlet valve member 10 extends beyond the valve bore 18, and out from an upper surface 20 of the pump head housing 2. The upper surface 20 of the pump head housing 2 is planar and substantially flat. A proximal end 22 of the neck 14 (adjacent to the conical body 12) remains within the pump head housing 2, whilst a distal end 24 of the neck 14 remains outside the pump head housing 2 and carries an armature 26, which acts as a spring seat. The armature 26 is fixed to the inlet valve member 10 by press-fitting it onto the neck 14. A valve return spring 28 is provided between the upper surface 20 of the pump head housing 2 and the armature 26 to urge the inlet valve member 10 closed against a valve seat 30 when fuel pressure within the gallery 16 drops below a threshold value. A slight recess 32 is provided in the otherwise flat upper surface 20 of the pump head housing 2 to locate the lower end of the spring 28 therein.

A closure member in the form of a valve cap 34 is mounted on top of and, thus, externally to, the upper surface 20 of the pump head housing 2. The valve cap 34 is provided over the distal end 24 of the neck 14 of the inlet valve member 10 (i.e. the part of the inlet valve member 10 that is outside the pump head housing 2). The valve cap 34 is a generally cylindrical member comprising a circular body portion 36 and an annular wall portion 37 which projects from the periphery of the body portion 36. The pump head housing 2 includes a raised portion or projection 40 that is substantially circular, and projects into, and fits the footprint of, the annular wall portion 37 of the valve cap 34. The valve cap 34 may be fitted over the raised portion 40 such that the raised portion 40 protrudes into the annular wall portion 37 in a manner similar to a plug and socket arrangement.

The valve cap 34 defines an external chamber 42 within which the distal end 24 of the inlet valve member 10 is housed. The radial outer surface of the projection 40 faces, and engages, a radial inner surface of the annular wall portion 37. The external chamber 42 is therefore defined between the internal surface of the valve cap 34, and the upper surface 20 of the raised portion 40. A low-pressure seal is provided between the radial inner surface of the annular wall portion 37 and the radial outer surface of the raised portion 40, for example by an O-ring (not shown in FIG. 1) surrounding the raised portion 40. The O-ring may be located within an annular groove provided in the radial outer surface of the raised portion 40 and serves to minimise the loss of fuel from the external chamber 42.

The body portion 36 of the valve cap 34 comprises an axial blind bore 38, which houses a solenoid coil 39. The solenoid coil 39 is arranged such that it is coaxial with the blind bore 38. When the valve cap 34 is attached to the pump head housing 2, the blind bore 38 of the body portion 36 is aligned such that it is coaxial with the valve bore 18 in the pump head housing 2. Accordingly, the solenoid coil 39 in the valve cap 34 is aligned such that it is coaxial with the inlet valve member 10 and, in turn, the armature 26. The armature 26 is made from a suitable ferromagnetic material such that energisation of the solenoid coil 39 causes an electromagnetic force to be exerted on the armature 26, and thus the inlet valve member 10 as will be described in more detail later.

An entry port 44 is provided in the annular wall portion 37 of the valve cap 34 to allow fuel to flow into the external chamber 42. The external chamber 42 communicates with the gallery 16 defined in the pump head housing 2 via a plurality of radial feed drillings 46 which are provided in the pump head housing 2. The radial feed drillings 46 extend between the gallery 16 and the upper surface 20 of the pump head housing 2, emerging at a position on the upper surface 20 of the pump head housing 2 which is outside the diameter of the spring 28. The radial feed drillings 46 are equally spaced about the circumference of the gallery 16.

The operation of the above-described inlet valve arrangement 9 will now be described.

In use, low-pressure fuel is pumped by a transfer or lift pump through the entry port 44 and into the external chamber 42. Typically, in the context of a common rail fuel injection system, the low-pressure fuel is supplied at a pressure of about 5 bar. The low-pressure fuel is then fed from the external chamber 42, through the radial feed drillings 46 in the pump head housing 2, and into the gallery 16. Movement of the inlet valve member 10 away from the valve seat 30 to allow fuel into the pumping chamber 6 is dependent on the balance of forces acting upon it. An opening force is provided by the difference in pressure between the inlet side of the inlet valve member 10, i.e. the fluid pressure in the gallery 16, and the fluid pressure in the pumping chamber 6. The closing force acting on the inlet valve member 10 is provided by the spring 28 and any electromagnetic force exerted on the armature 26 by the solenoid coil 39.

During a filling stroke of the high pressure pump, the pumping plunger 5 moves away from the inlet valve arrangement 9 and the volume of the pumping chamber 6 increases. This results in a negative pressure in the pumping chamber 6 of up to about −1 bar. As mentioned previously, the low pressure fuel may be supplied at a pressure of 5 bar. Accordingly, when the external chamber 42, and thus the gallery 16, are filled with fuel, the pressure on the inlet side of the valve arrangement will be 5 bar, which results in a total pressure difference, ΔP, between the inlet and outlet sides of the inlet valve member 10 of around 6 bar.

The spring 28 is selected such that the closing force it exerts on the inlet valve member 10 is less than opening force caused by the pressure difference, ΔP, across the inlet valve member 10 during a filling stroke. If the spring force were the only force acting to close the inlet valve member 10, then it would always open when the opening force caused by ΔP exceeded the spring force and close again when ΔP fell below spring force. However, by virtue of the solenoid 39, an additional force can be applied to the inlet valve member 10. As mentioned previously, when a current is passed through the solenoid 39 this produces an electromagnetic force which attracts the armature 26 and thus provides an additional closing force to the spring force. The greater the current in the solenoid coil 39, the greater the electromagnetic force on the armature 26 and, therefore, the greater the overall closing force acting on the inlet valve member 10. Accordingly, by varying the current applied to the solenoid coil 39, the pressure difference ΔP required to open the inlet valve member 10 varies, with higher current requiring a greater pressure difference ΔP and lower current requiring a lower pressure difference ΔP. Thus, by varying the current applied to the solenoid coil 39, the time at which the inlet valve member 10 opens and closes during operation of the high pressure pump can be controlled. This, in turn, enables the quantity of fuel which is delivered to the pumping chamber 6 to be controlled.

For example, if a relatively small current is applied to the solenoid coil 39, then the electromagnetic force on the armature 26 will be relatively small, resulting in a slightly larger closing force acting on the inlet valve member 10 than would be provided by the spring 28 alone. This means that the inlet valve member 10 will open slightly later during a filling stroke of the pumping plunger 5 and close slightly earlier when the pumping stroke commences. On the other hand, if a larger current is applied to the solenoid coil 39, the additional closing force exerted on the inlet valve member 10 will be greater still. Accordingly, the inlet valve member 10 will open later still and close earlier, thereby reducing the quantity of fuel delivered to the pumping chamber 6 compared to the case where the applied current is lower, or not applied at all. In this way, the solenoid coil 39 can be used to provided a variable force on the inlet valve member 10 to match the pressure difference ΔP across it at the beginning of the plunger stroke, towards the end of the stroke, or at any other time, thereby determining the time at which the inlet valve member 10 opens and closes, and the quantity of fuel delivered.

An inlet valve arrangement having the above-described configuration has a number of advantages over the use of a conventional inlet metering valve. Firstly, it is much smaller when compared to a conventional inlet metering valve and has a simple construction, thereby reducing cost and space requirements. Furthermore, no moving parts are required to adjust the amount of fuel delivered to the pumping chamber 6 beyond those parts which are incorporated into the fuel pump head 1 already. Thus, the above-described arrangement has increased durability compared to a system employing a conventional inlet metering valve. Also, the above-described fuel pump head 1 is easy to assemble because attachment of the valve cap 34 to the pump head housing 2 ensures that the solenoid coil 39 is correctly positioned with respect to the armature 26 on the inlet valve member 10.

The above-described inlet valve arrangement 9 is also convenient because, in the event of an electrical failure, it fails in the same way as a conventional inlet metering valve, meaning that it is compatible with the existing common rail system. More specifically, when the electrical supply to a conventional inlet metering valve is lost, the valve fails to an open state and results in 100% filling, i.e. the maximum amount of fuel is pumped by the transfer pump to the external chamber of the fuel pump head and onward to the pumping chamber when the inlet valve member opens. Any additional pressure in the system can be relieved by means of a pressure relief valve either on the common rail or on the valve. Likewise, with the inlet valve arrangement 9 described above, electrical failure would result in no additional closing force being provided by the solenoid coil 39 and, therefore, maximum filling, which would be relieved in the same way as in a system with a conventional inlet metering valve.

An inlet valve arrangement 9 having the above-described configuration is also advantageous when used in high-pressure pumps having multiple pumping plungers in order to balance the fuel delivered by each of the individual pumping elements. For example, a high-pressure pump may have two pumping plungers arranged on opposite sides of a cam mounted on a drive shaft, or three pumping plungers spaced equidistantly around the cam. Each pumping plunger is associated a separate fuel pump head 1, and thus an individual inlet valve arrangement 9. Accordingly, the solenoid coils 39 of the individual inlet valve arrangements 9 can be supplied with separate control signals, i.e. currents, from the Electronic Control Unit so that any variations between the various fuel pump heads (e.g. due to manufacturing tolerances) can be compensated for. This could be obtained by saving the electrical characteristics in for example a data matrix code or a learning function incorporated in the Electronic Control Unit.

In a variation of the above-described embodiment, the inlet port 44 of the valve cap 34 may be provided with a throttle which restricts the flow of fuel into the external chamber 42. With this configuration, the rate at which the fuel in the external chamber 42 is replenished by the transfer pump after the pumping chamber 6 has been filled is reduced. This is advantageous in that, during operation of the high-pressure pump, the fluid pressure in the external chamber 42 will never reach the full 5 bar pressure of the transfer pump, because the external chamber 42 is not refilled quickly enough for this to happen. Accordingly, the maximum pressure difference $\Delta P$ across the inlet valve member 10 is less. This means that a spring 28 with a lower spring force can be used and, in turn, the electromagnetic force applied to the armature 26 by the solenoid coil 39 in order to control the timing of the opening and closing of the inlet valve member 10 can be less. The requirement for a lower electromagnetic force from the solenoid coil 39 means that a smaller control current can be supplied to it, thereby saving energy.

Moreover, the above-described inlet valve arrangement 9 is advantageous in that the control current supplied to the solenoid coil 39 is a closed loop control with respect to the rail pressure. This contrasts with, for example, a situation in which a solenoid coil is directly coupled to the inlet valve member so as to directly control switching, i.e. opening and closing, of the inlet valve member. Such a direct-acting arrangement would require an encoder and thus a more complicated control architecture than that required by the above-described inlet valve arrangement 9.

In the embodiment described above with reference to FIG. 1, the inlet valve member 10 is integrated directly into the pump head housing 2. However, it will be appreciated by those skilled in the art that the inlet valve member 10 need not be directly integrated into the pump head housing 2. For example, the inlet valve arrangement 9 may be integrated with the valve cap 34.

The inlet valve member does not necessarily require a conical body: in alternative embodiments of the invention, the body may be spherical or any other suitable shape with the corresponding valve seat being suitably shaped.

The invention claimed is:

1. An inlet valve arrangement for a pump head of a fuel pump for use in a common rail fuel injection system, the inlet valve arrangement comprising;

an inlet valve member moveable between open and closed positions to control the flow from a source of low-pressure fuel to a pumping chamber of the fuel pump, wherein the open position opens a flow path between an inlet side of the inlet valve member and the pumping chamber and the closed position blocks the flow path and prevents fluid communication between the inlet side of the inlet valve and the pumping chamber, and wherein the inlet valve member is arranged to open in response to the pressure difference between the fluid pressure of fuel on an inlet side of the inlet valve member and the fluid pressure in the pumping chamber exceeding a threshold value;

the inlet valve arrangement comprising means for selectively applying a closing force on the inlet valve member to bias it toward the closed position, such that, in use, the application of the closing force by said means acts to increase the threshold value of the pressure difference at which the inlet valve member opens.

2. An inlet valve arrangement according to claim 1, wherein said means for selectively applying a closing force is operable to apply a force which varies proportionally with a control signal.

3. An inlet valve arrangement according to claim 1, wherein said means comprises an electrical component.

4. An inlet valve arrangement according to claim 1, wherein said means comprises a solenoid coil operable to exert a closing force on the inlet valve member which is proportional to an electric current flowing therein.

5. An inlet valve arrangement according to claim 4, comprising an armature of ferromagnetic material coupled to the inlet valve member, such that the solenoid coil exerts an electromagnetic force on the armature when an electric current flows within the solenoid coil.

6. An inlet valve arrangement according to claim 1, comprising a spring arranged to bias the inlet valve member toward the closed position, wherein the threshold value of the pressure difference corresponds to an opening force on the inlet valve member which is greater than the closing force exerted by the spring.

7. A pump head for a fuel pump for use in a common rail fuel injection system, the pump head comprising a pump head housing and an inlet valve arrangement according to any preceding claim.

8. A pump head according to claim 7, wherein the fluid pressure of fuel on the inlet side of the inlet valve member is defined by the fluid pressure within a gallery, wherein the gallery communicates with an external chamber defined in part by a closure member mounted externally to the pump head housing, such that, in use, the gallery communicates with the source of low-pressure fuel via the external chamber.

9. A pump head according to claim 8, wherein the external chamber comprises an entry port, the entry port being adapted so as to restrict the flow from the source of low-pressure fuel into the external chamber such that, in use, the maximum fluid pressure in the external chamber is limited to a pressure which is less than the output pressure of the source of low-pressure fuel.

10. A pump head according to claim 9, wherein the entry port is provided in the closure member.

11. A pump head according to claim 8, wherein the inlet valve member comprises an elongate neck which is guided within a valve bore in the pump head housing, the valve bore extending between an upper surface of the pump head housing and a valve seat.

12. A pump head according to claim 11, wherein the external chamber is defined between the closure member and the upper surface of the pump head housing; and wherein a distal end of the neck, disposed away from the valve seat, projects above the upper surface of the pump head housing into the external chamber.

13. A pump head according to claim 12, wherein said means comprises a solenoid coil operable to exert a closing force on the inlet valve member which is proportional to an electric current flowing therein;

the inlet valve arrangement comprising an armature of ferromagnetic material coupled to the inlet valve member, such that the solenoid coil exerts an electromagnetic force on the armature when an electric current flows within the solenoid coil, and a spring arranged to bias the inlet valve member toward the closed position, wherein the threshold value of the pressure difference corresponds to an opening force on the inlet valve member which is greater than the closing force exerted by the spring;

wherein the armature projects radially outwards from the distal end of the neck and acts as a spring seat, the spring being disposed between the armature and the upper surface of the pump head housing.

14. A pump head according to claim 13, wherein the solenoid coil is mounted in or on the closure member such that, when closure member is mounted on the pump head housing, the solenoid coil is disposed adjacent to, and coaxial with, the distal end of the neck of the inlet valve member.

15. A fuel pump for use in a common rail fuel injection system, comprising at least one pump head according to claim 7.

* * * * *